US006218626B1

(12) United States Patent
Giampieretti et al.

(10) Patent No.: US 6,218,626 B1
(45) Date of Patent: Apr. 17, 2001

(54) INSULATOR FOR ELECTRIC TRANSMISSION AND DISTRIBUTION LINES, WITH IMPROVED RESISTANCE TO FLEXURAL STRESSES

(75) Inventors: Roberto Giampieretti, Milan; Alessandro Parolini, Bellusco, both of (IT)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/285,756

(22) Filed: Apr. 5, 1999

(30) Foreign Application Priority Data

Apr. 8, 1998 (IT) ..... MI98A0751

(51) Int. Cl.[7] ..... H01B 17/14

(52) U.S. Cl. ..... 174/158 R; 174/45 R; 174/163 R; 174/176; 174/178; 174/209; 174/194

(58) Field of Search ..... 174/43, 45 R, 174/158 R, 161 F, 163 R, 169, 176, 177, 178, 194, 197, 209

(56) References Cited

U.S. PATENT DOCUMENTS 1,728,531 * 9/1929 Estorff ..... 174/177
3,213,254 * 10/1965 Strom ..... 174/178
5,977,487 * 11/1999 Kuhl ..... 174/176
5,981,878 * 11/1999 Zhao et al. ..... 174/158 R
5,985,087 * 11/1999 Karl et al. ..... 174/176

FOREIGN PATENT DOCUMENTS 0 933 787 8/1999 (EP) .
7-245027 9/1995 (JP) .

* cited by examiner

*Primary Examiner*—Kristine Kincaid
*Assistant Examiner*—Adolfo Nino
(74) *Attorney, Agent, or Firm*—Oblon, Spivak, McClelland, Maier & Neustadt, P.C.

(57) ABSTRACT

A hollow insulator for electric transmission and/or distribution lines including an insulating hollow tube made of composite material which is coupled, at least at an end portion thereof, to a metal flange which has a portion adapted to be inserted into the hollow tube. The coupling between the metal flange and the insulating tube is provided by means of a plurality of connection elements adapted to transfer to the flange flexural stresses due to flexural moments applied to the tube. The connection elements work substantially under shearing stress.

20 Claims, 2 Drawing Sheets

INSULATOR FOR ELECTRIC TRANSMISSION AND DISTRIBUTION LINES, WITH IMPROVED RESISTANCE TO FLEXURAL STRESSES

BACKGROUND OF THE INVENTION

The present invention relates to an insulator, particularly for electric transmission and distribution lines, with improved resistance to flexural stresses.

More particularly, the invention relates to a hollow insulator for pole heads for supporting pylons in electrical transmission and/or distribution lines.

It is known that hollow insulators are generally constituted by a tube made of composite material, typically fiberglass-reinforced plastic, around which insulating ribs made of silicone material are arranged; suitable metallic flanges are also fixed to one or both ends of the tube and allow to couple the insulator to an additional element, such as for example another insulator or the frame of a supporting pylon.

In the current state of the art, the flanges are fixed to the ends of the insulator in most cases by gluing: in particular, depending on the requirements and/or on the specific applications and on the geometric configuration of the flanges, gluing can be performed on the internal surface of the insulator, on the external surface, or on both.

This solution entails several drawbacks, the critical importance of which becomes apparent when the insulator is installed and is required to withstand certain structural loads.

In particular, in the field of electrical transmission lines, new applications require the entire pole head of the supporting pylons to be formed with hollow insulators of the above-described type, so as to entrust to a single component both the structural function and the dielectric function; the purpose of this solution is to drastically reduce the lateral dimensions of the pylon, thus reducing its environmental impact.

In these applications, the insulators are required to perform particular demanding structural tasks; in particular, the type of stress whereto they are subjected is mainly flexural and becomes critically apparent at the end flanges, where the applied flexural moment is highest.

The insulated tube made of composite material is in fact inherently able to withstand much higher flexural moments in sections not close to the flange than proximate to the coupling between the tube and the flange: the flexural moments applied to the tube, however, are discharged from the tube onto the interface for connecting the flange and onto the flange itself, determining regions of high stress concentration especially at particular regions of the interface between the flange and the tube. Specifically, the transfer of flexural stresses from the composite tube to the metal flange is entrusted to the gluing, and although the tube is capable of withstanding the flexural moment applied to it, the weakest element of the coupling between the tube and the flange, i.e, the gluing element, is unable to withstand said flexural moment. Accordingly, the stresses tend to cause, even for low values of the flexural moment applied to the tube, not only cracks in the layer of adhesive but even a mutual separation of the tube and the flange, causing a consequent problem.

In particular, experimental tests and numerical analyses show that the loadbearing ability of the coupling is insufficient with respect to the maximum flexural moments generated by the loads that affect the pole head.

One of the solutions that can be adopted in order to obviate this drawback is the use of composite tubes whose diameters and thicknesses are considerably oversized; this solution is clearly disadvantageous both from the point of view of costs, which would increase considerably, and from the point of view of visual impact, which would be negatively affected by the increased dimensions of the insulator.

Another solution for improving the flexural performance of conventional insulators might be achieved, at least theoretically, by appropriately enlarging the portions of tube that are in contact with the flanges. However, this solution entails a certain complication of the process for winding the fibers of which the tubes are made (so-called filament winding), consequently entailing a considerable increase in production costs and therefore ultimately producing a product which is not competitive from the economical point of view.

It should be observed that in any case the solution that includes gluing has the severe drawback that it has a brittle fracture mode, i.e., structural failure becomes apparent suddenly and without warning and practically coincides with exit from the elastic range. For applications such as the insulating pole head it is instead desirable for failure to occur "plastically", i.e., for the structure, after leaving its elastic range, to be capable of maintaining extreme loads by undergoing even great permanent deformations but with the undisputed advantage, in terms of safety, of maintaining integrity.

SUMMARY OF THE INVENTION

The aim of the present invention is to provide a hollow insulator, particularly for pole heads of supporting pylons in electric transmission and/or distribution lines, which allows to considerably improve the maximum flexural moment that can be withstood with respect to that of conventional-type insulators.

Within the scope of this aim, an object of the present invention is to provide a hollow insulator, particularly for pole heads of supporting pylons in electric transmission and/or distribution lines, whose fracture mode is not brittle but plastic, thus allowing to increase the safety margins.

Another object of the present invention is to provide a hollow insulator, particularly for pole heads of supporting pylons in electric transmission and/or distribution lines, which allows to achieve a considerable improvement in the level of flexural moment that can be withstood without changing the types of material used, the geometric dimensions and the production processes of said insulator.

Another object of the present invention is to provide a hollow insulator, particularly for pole heads of supporting pylons in electric transmission and/or distribution lines, which is highly reliable, relatively easy to manufacture and at competitive costs.

This aim, these objects and others which will become apparent hereinafter are achieved by a hollow insulator according to the present invention, particularly for pole heads of supporting pylons in electric transmission and/or distribution lines, which comprises an insulating tube made of composite material coupled to a metal flange at least at an end portion, characterized in that the coupling between the metal flange and the insulating tube is provided by means of a plurality of connection means suitable to transfer to the flange flexural stresses due to flexural moments applied to the tube, said connection means working substantially under shearing stress.

In this way, one has the great advantage of considerably increasing the maximum flexural stresses that can be withstood by the joint and therefore by the insulator as a whole, without altering the geometry and/or the dimensions of the insulating tube.

BRIEF DESCRIPTION OF THE DRAWINGS

Further characteristics and advantages of the present invention will become apparent from the following detailed description of preferred but not exclusive embodiments of the insulator according to the invention, illustrated only by way of non-limitative example in the accompanying drawings, wherein.

DESCRIPTION OF THE PREFERRED EMBODIMENTS

Figure 1:
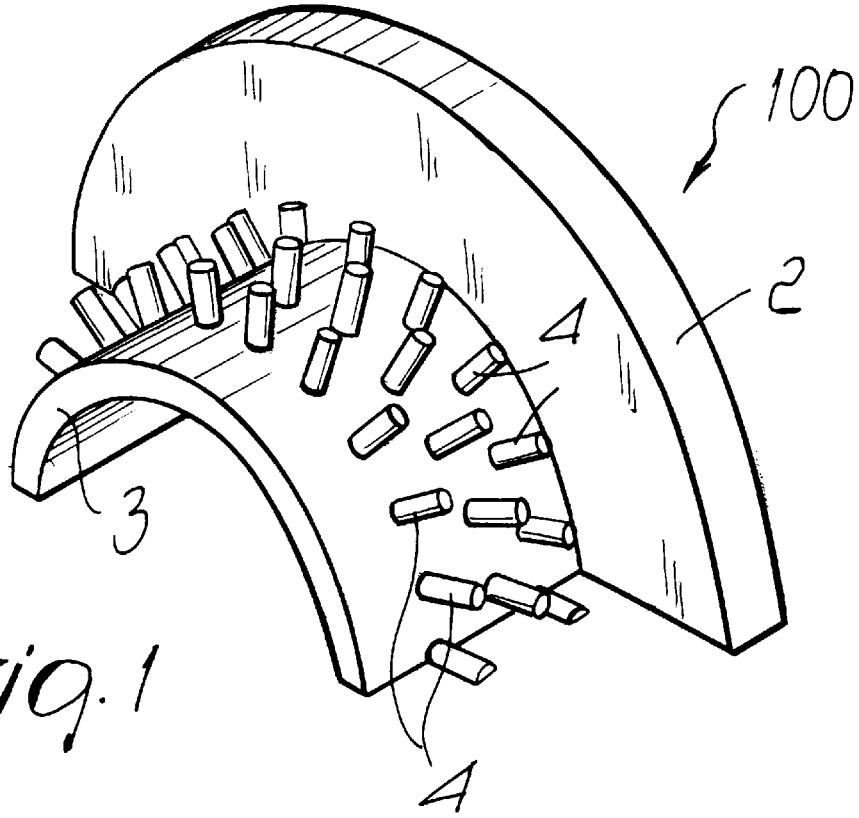
FIG. 1 is a partial perspective view of a flange used in the insulator according to the present invention.

With reference to the above figures, the hollow insulator according to the present invention comprises an insulating tube 1 made of composite material, preferably fiberglass-reinforced plastic, and at least one metal flange, preferably made of aluminum, which is generally designated by the reference numeral 100. In particular, as shown in FIGS. 1 and 3, the metal flange 100 is essentially constituted by two parts: a circular part 2, which allows the coupling of the insulator to another element, for example another insulator or a frame, and a cylindrical part 3, which is conveniently connected to the tube 1.

Advantageously, in the embodiment of the insulator according to the present invention, the connection between the flange 100 and the tube 1 is provided by means of a plurality of connection means which, by acting substantially under shearing stress, transfer to the flange 100 the flexural stresses due to flexural moments applied to the tube 1.

Figure 3:
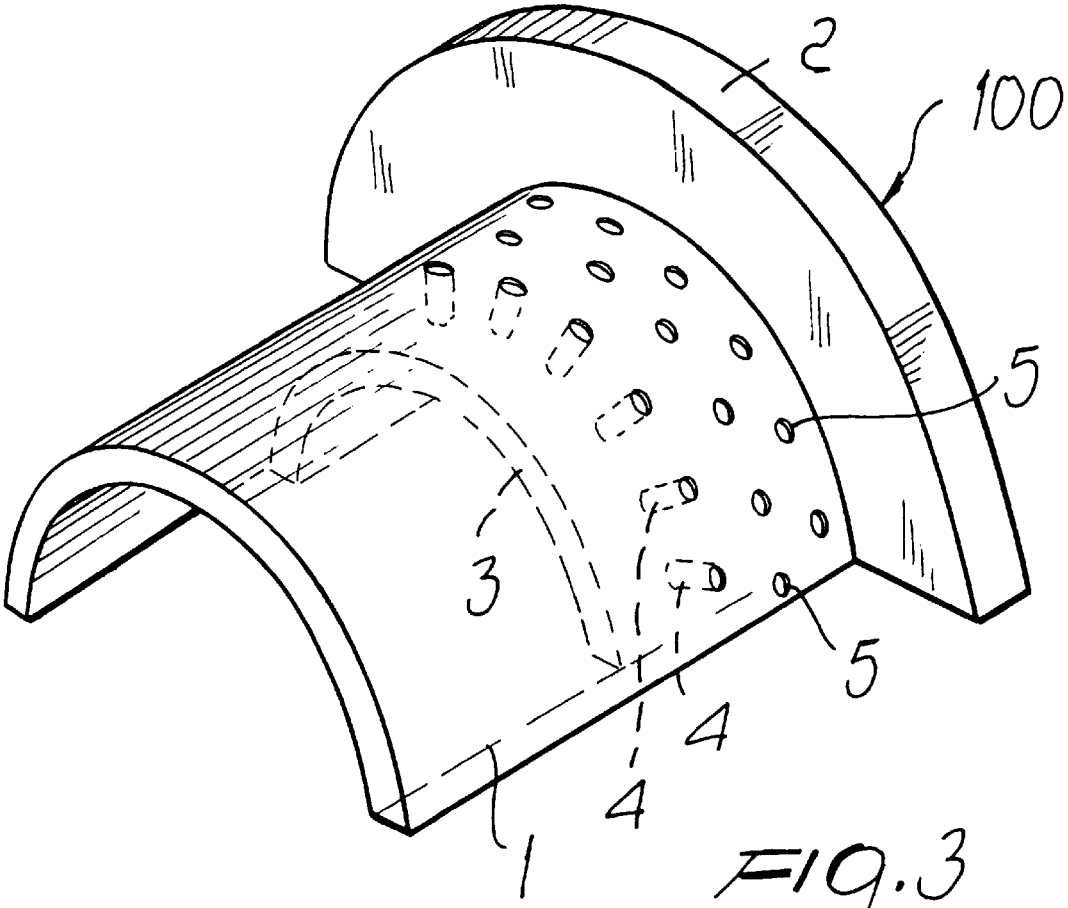
FIG. 3 is a partial perspective view of a first embodiment of the coupling between the tube and the flange in the insulator according to the invention.

As shown in detail in FIGS. 1 and 3, the connection means are constituted by metallic or composite pins 4 which are fixed to the flange 100 and engage in corresponding holes 5 formed in the surface of the tube 1; in particular, in the illustrated embodiment the pins 4 are constituted by steel cylinders, at least one end portion 4' whereof is threaded, which are screwed in blind seats 6 formed in the flange 100.

In particular, the pins 4, which protrude from the cylindrical part 3 of the flange, are arranged on such part 3 along one or more circumferential rows and the axis 7 (FIG. 4) of each pin 4 is substantially perpendicular to the longitudinal axis 8 of the tube 1. This solution allows the pins 4 to be subjected only to shearing stress and facilitates the operations for mutually fixing the flange 100 and the tube 1.

Figure 2:
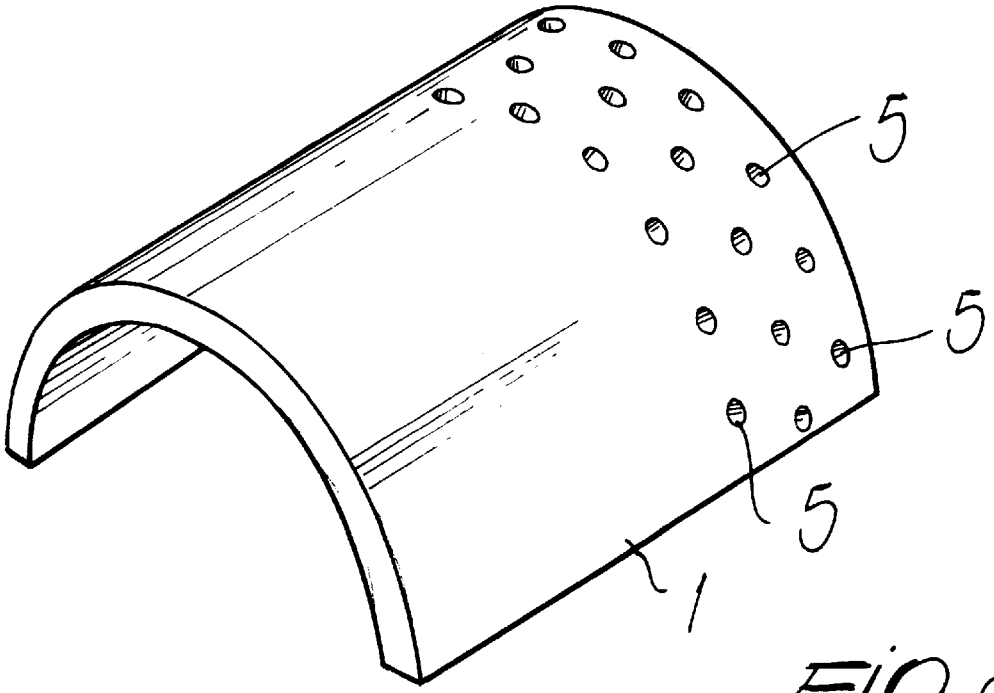
FIG. 2 is a partial schematic view of a composite tube used in the insulator according to the invention.

In a preferred embodiment of the insulator according to the present invention, the pins 4 are arranged along at least two parallel circumferential rows and, with reference to the longitudinal axis 8 of the tube 1, the pins 4 that belong to one row are staggered with respect to those of the adjacent row. Accordingly, the corresponding holes 5 formed in the tube 1 that belong to two adjacent rows are also staggered, as shown in FIG. 2. This advantageously allows to mutually space the holes and increase the resisting cross-section of the tube 1, thus helping to improve the overall structural strength of the insulator.

Figure 4:
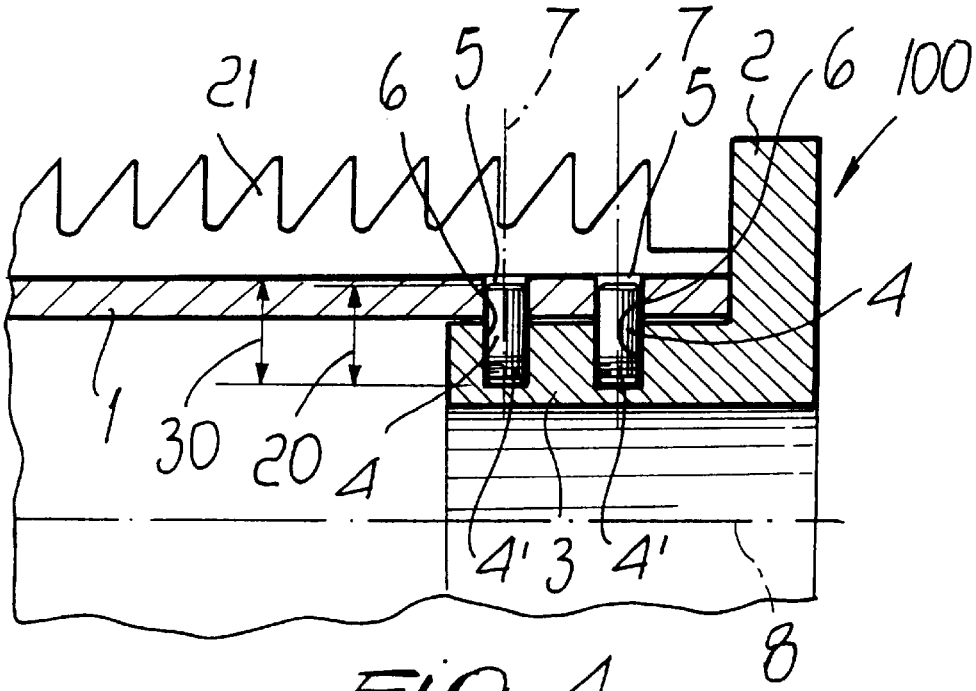
FIG. 4 is a partial sectional view, taken along a longitudinal plane, of a detail of a second embodiment of the coupling between the insulating tube and the flange in the insulator according to the invention.

Referring to FIG. 4, another advantage of the insulator according to the present invention is that the pins 4 have a height 20 which is equal to, or in any case smaller than, a distance 30 calculated between the bottom of the seats 6 formed in the flange 100 and the external surface of the insulating tube 1. In this way the pins 4, once fixed, do not protrude from the tube 1 and allow to cover also the tube-flange coupling region with insulating ribs 21, which are typically made of silicone rubber. This ensures the dual effect of keeping the leakage length of the insulator unchanged and, by means of the sealing of the through holes 5, of preventing any passage of moisture into the tube 1, which would compromise the dielectric strength of the insulator.

As can be seen in FIGS. 3 and 4, the flange is connected to the internal surface of the tube.

In practice it has been observed that the insulator according to the present invention allows to fully achieve the intended aim and objects, since it allows to considerably increase the maximum flexural moment that can be withstood with respect to conventional-type insulators; moreover, experimental tests and numerical analyses have shown that the insulator has a fracture mode which is not brittle but plastic, since between the flexural moment at the elastic limit (first ply failure) and the flexural moment that produces fracture (ultimate laminate failure) there is a significant margin over which the insulating tube retains the loads applied, undergoing great permanent deformations (delamination) but maintaining its structural integrity and thus increasing safety.

The current insulator thus conceived is susceptible of numerous modifications and variations, all of which are within the scope of the inventive concept; all the details may also be replaced with other technically equivalent elements.

In practice, the materials used, as well as the dimensions, may be any according to requirements and to the state of the art.

The disclosures in Italian Patent Application No. MI98A000751 from which this application claims priority are incorporated herein by reference.

What is claimed is:

1. A hollow insulator for electric transmission and/or distribution lines, comprising an insulating hollow tube made of composite material which is coupled, at least at an end portion thereof, to a metal flange having a portion adapted to be inserted into the hollow tube, wherein the coupling between the metal flange and the insulating tube is provided by means of a plurality of connection means adapted to transfer to the flange flexural stresses due to flexural moments applied to the tube, said connection means working substantially under shearing stress.

2. The hollow insulator according to claim 1, wherein said connection means comprise pins which are fixed to the flange and engage in corresponding holes formed in the tube.

3. The hollow insulator according to claim 2, wherein said pins are constituted by steel cylinders which are screwed, at least at an end portion, in seats defined in the flange.

4. The hollow insulator according to claim 2, wherein said pins and said holes are arranged along a circumferential row and have an axis substantially perpendicular to the longitudinal axis of the insulating tube.

5. The hollow insulator according to claim 2, wherein said pins and said holes are arranged along at least two parallel circumferential rows and have an axis which is substantially perpendicular to the longitudinal axis of the insulating tube.

6. The hollow insulator according to claim 5, wherein the pins and the corresponding holes formed in the insulating tube and belonging to two adjacent parallel circumferential rows are mutually staggered with respect to the longitudinal axis of said tube.

7. The hollow insulator according to claim 2, wherein said pins are as high as, or lower than, a distance calculated between a bottom of said seats defined in the flange and an outer surface of the insulating tube.

8. The hollow insulator according to claim 1, wherein said metal flange is made of aluminium and is connected to the internal surface of the tube.

9. A hollow insulator for electric transmission and/or distribution lines, comprising an insulating tube made of composite material which is coupled, at least at an end portion thereof, to a metal flange, wherein the coupling between the metal flange and the insulating tube is provided by means of a plurality of connection means adapted to transfer to the flange flexural stresses due to flexural moments applied to the tube, said connection means working substantially under shearing stress and comprising pins which are fixed to the flange and engage in corresponding holes formed in the tube, wherein said pins are constituted by steel cylinders which are screwed, at least at an end portion, in seats defined in the flange.

10. The hollow insulator according to claim 9, wherein said pins and said holes are arranged along a circumferential row and have an axis substantially perpendicular to the longitudinal axis of the insulating tube.

11. The hollow insulator according to claim 9, wherein said pins and said holes are arranged along at least two parallel circumferential rows and have an axis which is substantially perpendicular to the longitudinal axis of the insulating tube.

12. The hollow insulator according to claim 11, wherein the pins and the corresponding holes formed in the insulating tube and belonging to two adjacent parallel circumferential rows are mutually staggered with respect to the longitudinal axis of said tube.

13. The hollow insulator according to claim 9, wherein said pins are as high as, or lower than, a distance calculated between a bottom of said seats defined in the flange and an outer surface of the insulating tube.

14. The hollow insulator according to claim 9, wherein said metal flange is made of aluminum and is connected to the internal surface of the tube.

15. A hollow insulator for electric transmission and/or distribution lines, comprising an insulating tube made of composite material which is coupled, at least at an end portion thereof, to a metal flange, wherein the coupling between the metal flange and the insulating tube is provided by means of a plurality of connection means adapted to transfer to the flange flexural stresses due to flexural moments applied to the tube, said connection means working substantially under shearing stress and comprising pins which are fixed to the flange and engage in corresponding holes formed in the tube, wherein said pins and said holes are arranged along a circumferential row and have an axis substantially perpendicular to the longitudinal axis of the insulating tube.

16. The hollow insulator according to claim 15, wherein said pins are constituted by steel cylinders which are screwed, at least at an end portion, in seats defined in the flange.

17. The hollow insulator according to claim 15, wherein said pins and said holes are arranged along at least two parallel circumferential rows and have an axis which is substantially perpendicular to the longitudinal axis of the insulating tube.

18. The hollow insulator according to claim 17, wherein the pins and the corresponding holes formed in the insulating tube and belonging to two adjacent parallel circumferential rows are mutually staggered with respect to the longitudinal axis of said tube.

19. The hollow insulator according to claim 15, wherein said pins arc as high as, or lower than, a distance calculated between a bottom of said seats defined in the flange and an outer surface of the insulating tube.

20. The hollow insulator according to claim 15, wherein said metal flange is made of aluminum and is connected to the internal surface of the tube.

* * * * *